US008733251B1

(12) United States Patent
Abboud et al.

(10) Patent No.: US 8,733,251 B1
(45) Date of Patent: May 27, 2014

(54) CONDUCTIVE ENERGY WEAPON AMMUNITION

(71) Applicants: Steven Abboud, Omaha, NE (US); Chi-Myin Chang, Taichung (TW)

(72) Inventors: Steven Abboud, Omaha, NE (US); Chi-Myin Chang, Taichung (TW)

( * ) Notice: Subject to any disclaimer, the term of this patent is extended or adjusted under 35 U.S.C. 154(b) by 0 days.

(21) Appl. No.: 13/735,933

(22) Filed: Jan. 7, 2013

Related U.S. Application Data

(60) Provisional application No. 61/584,136, filed on Jan. 6, 2012.

(51) Int. Cl.

| | |
|---|---|
| ***F41B 15/04*** | (2006.01) |
| ***F41B 11/06*** | (2006.01) |
| ***H05C 1/00*** | (2006.01) |
| ***F41H 13/00*** | (2006.01) |

(52) U.S. Cl.
USPC ..... 102/502; 361/232; 124/57

(58) Field of Classification Search
USPC ..... 102/502, 504, 512; 124/57; 361/232; 42/84; 89/1.34
See application file for complete search history.

(56) References Cited

U.S. PATENT DOCUMENTS

| | | | | |
|---|---|---|---|---|
| 3,803,463 | A * | 4/1974 | Cover | 361/232 |
| 5,078,117 | A * | 1/1992 | Cover | 124/71 |
| 5,786,546 | A * | 7/1998 | Simson | 102/438 |
| 5,996,503 | A * | 12/1999 | Woodall et al. | 102/498 |
| 7,075,770 | B1 | 7/2006 | Smith | |
| 7,305,787 | B1 | 12/2007 | Stratbucker | |
| 7,600,337 | B2 | 10/2009 | Nerheim et al. | |
| 7,676,972 | B2 * | 3/2010 | Smith et al. | 42/1.08 |
| 7,859,818 | B2 | 12/2010 | Kroll et al. | |
| 7,944,676 | B2 | 5/2011 | Smith et al. | |
| 8,045,316 | B2 | 10/2011 | Nerheim | |
| 8,320,098 | B2 | 11/2012 | Klug et al. | |
| 2006/0187610 | A1 * | 8/2006 | Su | 361/232 |
| 2008/0276822 | A1 * | 11/2008 | Lubbers et al. | 102/502 |
| 2010/0146835 | A1 * | 6/2010 | McNulty, Jr. | 42/1.08 |
| 2010/0315755 | A1 * | 12/2010 | Gavin | 361/232 |

OTHER PUBLICATIONS

Raysun X-1 Product Description by Defenders Network, Inc., accessed at least as early as Dec. 21, 2012, available at http://www.defend-net.com/raysun/index.options.html.

Raysun XI Multi-Mode Police Weapon Product Description by Defenders Network, Inc., accessed at least as early as Dec. 21, 2012, available at http://www.defend-net.com/raysun/index.options.html.

(Continued)

*Primary Examiner* — Bret Hayes
(74) *Attorney, Agent, or Firm* — Adam R. Stephenson, Ltd.

(57) ABSTRACT

Ammunition for a conductive energy weapon. A receptacle includes a cavity accessible through each of a first opening in a first face of the receptacle, a second opening in the first face of the receptacle, a third opening in a second face of the receptacle and a fourth opening in a third face of the receptacle. A propellant unit is included within the cavity proximate the second opening and a projectile is included within the cavity proximate the second opening. A housing is coupled to at least the second face and the third face of the receptacle and is further configured to couple to the conductive energy weapon. The propellant unit releases a propellant into the cavity, in a direction substantially opposite the projectile's direction of flight, in response to a trigger pull of the conductive energy weapon, and the cavity directs the propellant in the projectile's direction of flight.

4 Claims, 10 Drawing Sheets

(56) References Cited

OTHER PUBLICATIONS

Raysun XI Multi-Mode Police Weapon Catalog Page by Defenders Network, Inc., accessed at least as early as Dec. 21, 2012, available at http://www.defend-net.com/raysun/Images/Raysun%20X1%020print.pdf.

Raysun XI Non-Lethal Police Weapon Operations Manual by Defenders Network, Inc., published at least as early as 2009, available at http://www.defend-net.com/raysun/Images/Raysun%20Instr.%20outside.pdf.

Raysun X-I Product Advertisement on May 1, 2009 internet archive of www.JiunAn.com website, available at http://web.archive.org/web/20090501084907/http://www.jiunan.com.tw/en/defense/stungun-x1.html.

* cited by examiner

CONDUCTIVE ENERGY WEAPON AMMUNITION

CROSS REFERENCE TO RELATED APPLICATIONS

This document claims the benefit of the filing date of U.S. Provisional Patent Application No. 61/584,136, entitled "Conductive Energy Weapon Ammunition and Related Methods" to Steven Abboud et al. which was filed on Jan. 6, 2012, the disclosure of which is hereby incorporated entirely herein by reference.

BACKGROUND

1. Technical Field

Aspects of this document relate generally to ammunition for a conductive energy device (CED), also known as a conductive energy weapon (CEW).

2. Background Art

Conductive energy weapons are weapons that fire projectiles to administer an electrical shock to a target.

SUMMARY

Implementations of ammunition for a conductive energy weapon may include: a receptacle having a cavity therein, the cavity accessible through each of a first opening in a first face of the receptacle, a second opening in the first face of the receptacle, a third opening in a second face of the receptacle and a fourth opening in a third face of the receptacle; a propellant unit included within the cavity proximate the first opening; a projectile included within the cavity proximate the second opening, and; a housing coupled to the receptacle, the housing configured to couple to the conductive energy weapon.

Implementations of ammunition for a conductive energy weapon may include one, all, or any of the following:

The first face may be substantially perpendicular to the second face.

The second face may be substantially parallel with the third face.

The ammunition may further include a first plug forming a substantially airtight seal with the receptacle proximate the third opening and a second plug forming a substantially airtight seal with the receptacle proximate the fourth opening.

The housing may be configured to cover substantially all of the receptacle except the first face.

The propellant unit may be configured to release a propellant into the cavity, in a direction substantially opposite a direction of flight of the projectile, in response to a trigger pull of the conductive energy weapon.

The ammunition may further include two electrical conductors on opposing sides of the receptacle.

The ammunition may further include an openable member coupled to the housing and substantially covering the first face, the openable member configured to expose the first face, in response to one of an explosion of an explosive proximate the first opening and an acceleration of the projectile.

Implementations of ammunition for a conductive energy weapon may include: a receptacle having a cavity therein, the cavity accessible through a first opening in a first face of the receptacle and a second opening in the first face of the receptacle; a propellant unit included within the cavity; a projectile included within the cavity, and; a housing coupled to the receptacle and configured to couple to the conductive energy weapon; wherein the propellant unit is configured to release a propellant into the cavity, in a direction substantially opposite a direction of flight of the projectile, in response to a trigger pull of the conductive energy weapon, and; wherein the cavity is configured to direct the released propellant in the direction of flight of the projectile.

Implementations of ammunition for a conductive energy weapon may include one, all, or any of the following:

The propellant may include a gas.

The cavity may be configured to cause the propellant to make two about ninety-degree turns on a flow path from the propellant unit to the projectile.

The cavity may be further accessible through a third opening on a second face of the receptacle, the second face substantially perpendicular to the first face.

The propellant unit may include a compressed fluid container, and the ammunition may further include an explosive positioned proximate a first end of the compressed fluid container and a mechanical pierce proximate a second end of the compressed fluid container, and the mechanical pierce may be configured to pierce the compressed fluid container in response to motion of the compressed fluid container in response to an explosion of the explosive.

The ammunition may further include a seal configured to form a substantially airtight seal with the receptacle at one of the second opening and a sidewall of the cavity proximate the second opening.

The ammunition may further include two electrical conductors on opposing sides of the receptacle.

The ammunition may further include an openable member coupled to the housing and substantially covering the first opening and the second opening, the openable member configured to expose the first opening and the second opening in response to one of an explosion of an explosive proximate the first opening and an acceleration of the projectile.

Implementations of ammunition for a conductive energy weapon may utilize implementations of a method of use of ammunition of a conductive energy weapon. Implementations of the method may include coupling an ammunition into a cavity of a muzzle of the conductive energy weapon. The ammunition may include housing configured to couple to the conductive energy weapon; a first receptacle and a second receptacle to the housing, the first receptacle having a cavity therein accessible through a first opening on a first face of the first receptacle, the second receptacle having a cavity therein accessible through a first opening on a first face of the second receptacle; a propellant unit included within the cavity of the first receptacle and a propellant unit included within the cavity of the second receptacle; and a first projectile included within the cavity of the first receptacle and a second projectile included within the cavity of the second receptacle; and discharging one of the first projectile and the second projectile in response to a trigger pull of the conductive energy weapon.

Implementations of a method of use of ammunition of a conductive energy weapon may include one, all, or any of the following:

The method may further include discharging both the first projectile and the second projectile in response to a single trigger pull of the conductive energy weapon.

The method may further include discharging the first projectile in response to a first trigger pull of the conductive energy weapon and discharging the second projectile in response to a second trigger pull of the conductive energy weapon.

The first projectile may be a different type of projectile than the second projectile.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

Figure 1:
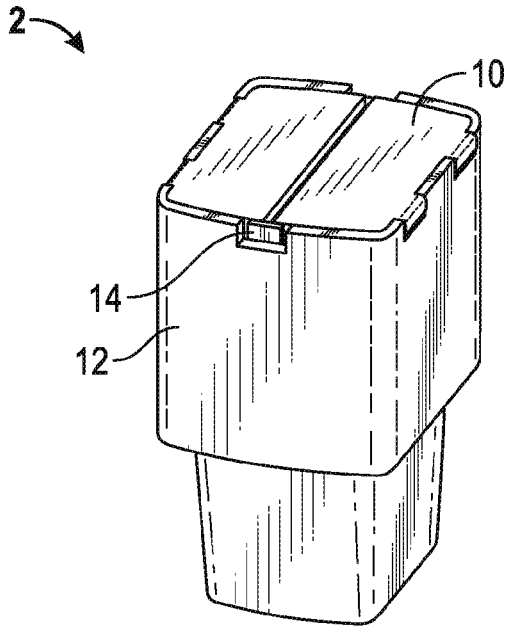
FIG. 1 is a perspective view of an implementation of ammunition for a conductive energy weapon.
Figure 2:
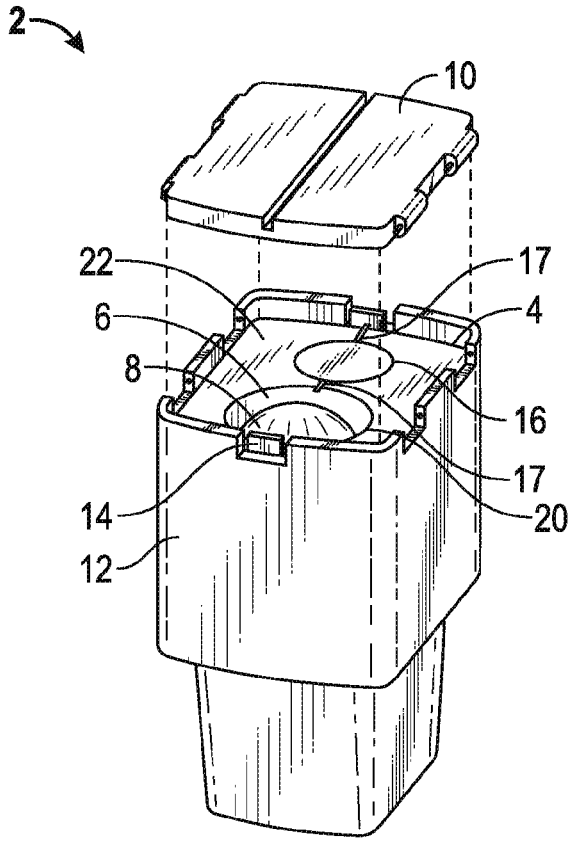
FIG. 2 is a partially exploded perspective view of an implementation of ammunition for a conductive energy weapon.

This disclosure, its aspects and implementations, are not limited to the specific components, assembly procedures or method elements disclosed herein. Many additional components, assembly procedures and/or method elements known in the art consistent with the intended conductive energy weapon ammunition and related methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such conductive energy weapon ammunition and related methods, and implementing components and methods, consistent with the intended operation and methods.

Referring now to FIGS. 1-6, in implementations ammunition 2 for a conductive energy weapon includes a receptacle 4 having a cavity 6 therein, the cavity 6 accessible through each of a first opening 18 in a first face 22 of the receptacle 4, a second opening 20 in the first face 22, a third opening 24 in a second face 26 of the receptacle 4 and a fourth opening 28 in a third face 30 of the receptacle 4. In implementations a propellant unit 32, having a first end 34 and a second end 36, is included within the cavity 6 proximate the first opening 18. In implementations an explosive 38 is included in the cavity 6 proximate the first end 34 of the propellant unit 32, the explosive 38 having two leads 17 configured to couple to two electrical conductors 14 coupled to the housing 12 to provide electricity to the leads 17 for purposes of exploding the explosive 38. In implementations a seal 16 covers the first opening 18. In implementations the seal 16 forms a substantially airtight seal with the receptacle 4 at the first opening 18. In implementations a projectile 8 is included within the cavity 6 proximate the second opening 20. In implementations the receptacle 4 is coupled to a housing 12 which is configured to be coupled to a conductive energy weapon. In implementations an openable member 10 couples to the housing 12 in a way that it covers the first face 22 and, accordingly, the first opening 18 and second opening 20.

The receptacle 4 in implementations is shaped to fit snugly inside the housing 12. In implementations the receptacle 4 and/or housing 12 may be configured so that a snap-fit or other type of fit is formed between them. In implementations the receptacle 4 may be fixed to the housing 12 such as, by non-limiting example, a friction fit, glue, a melting process, a permanent snap-fit, prongs, threads, and the like.

The cavity 6 may be any size, any configuration and any regular or irregular closed or open shape(s). In implementations the cavity 6 may be integrally formed into the receptacle 4 upon formation of the receptacle 4, such as during a molding process and/or may be formed by one or more machining processes after forming the receptacle 4. While in this document implementations of receptacles that have one cavity 6 for projectiles are illustrated, in various implementations, more than one cavity 6 for various projectiles may be included in other implementations. Also, where multiple projectiles and multiple cavities 6 are utilized, multiple propellant units with their corresponding cavities and components may be included in the receptacle 4 as well.

The projectile 8 may include any type of projectile including, but not limited to: a pepper ball; a paint ball; pepper powder; a rubber bullet; a dart or electrode; a non-electrified dart; and the like. The projectile 8 may include one or more projectiles and may include any combination of the aforementioned projectiles.

In implementations the openable member 10 is configured to cover substantially the entire first face 22 of the receptacle 4 and, accordingly, the first opening 18 and second opening 20. In implementations the openable member 10 could be configured to only partially cover the first face 22, such as to cover only either the first opening 18 or second opening 20. In implementations the openable member 10 may be configured to cover either or both of the first opening 18 and second opening 20 but may be configured to substantially not cover the first face 22 such as, by non-limiting example, in implementations wherein an openable member 10 is situated within the cavity 6 at the level of or just below the first opening 18 or second opening 20, or both. In implementations an openable member 10 may be omitted such that the first face 22, first opening 18 and second opening 20 are exposed.

In implementations the openable member 10 includes two doors separated by a frangible section there between, each door being hinged or snap-fit to the housing 12. In such an implementation an explosion of the explosive 38 and/or the acceleration or discharge of the projectile 8 may cause the frangible section to break and the two doors to hinge open or otherwise break away from the housing 12 such as to allow the projectile 8 to discharge along a desired direction of flight. In implementations the entire openable member 10 may be fabricated from a frangible material such that an explosion of the explosive 38 and/or the discharge or acceleration of the projectile 8 causes the openable member 10 to rupture, thus allowing the projectile 8 to discharge along a desired direction of flight. In implementations the openable member 10 may be fabricated of a non-frangible material or may be otherwise designed to not rupture but instead to swing upon (such as upon a hinge) or break away from the housing 12 in response to an explosion of the explosive 38 or the acceleration or discharge of the projectile 8 such that the projectile 8 is allowed to fly in a desired direction of flight. By non-limiting example, the openable member 10 may be loosely or lightly coupled to the housing 12 such that little force is required to remove it, such that the projectile 8 and/or an explosion of the explosive 38 will remove or open the openable member 10 without largely reducing the momentum of the discharged projectile 8.

The housing 12 is configured to couple to a conductive energy weapon. In implementations the housing 12 is configured to at least partially cover the second face 26 and third face 30. In implementations the housing 12 is configured to form a substantially air-tight seal with the receptacle 4 at the third opening 24 and fourth opening 28, though in other implementations the housing 12 does not form a substantially air-tight seal with the receptacle 4. In implementations the housing 12 is configured to cover substantially all of the receptacle 4 except the first face 22. In implementations substantially all of the housing 12 is configured to fit inside a cavity of a muzzle (cartridge receiving portion) of a conductive energy weapon though, in other implementations, only a lower portion (shown in FIGS. 1-3 as the bottom half of housing 12 having a smaller diameter) is configured to fit inside a cavity of a muzzle of a conductive energy weapon, with the remainder of the housing 12 extending outwards in front of and outside of the muzzle of the conductive energy weapon. In such implementations the electrical conductors 14 may exit the housing 12 at or near the section of the housing 12 where the diameter is reduced so as to touch or couple thereat to electrodes of the conductive energy weapon to provide electricity to the electrical conductors 14.

Figure 3:
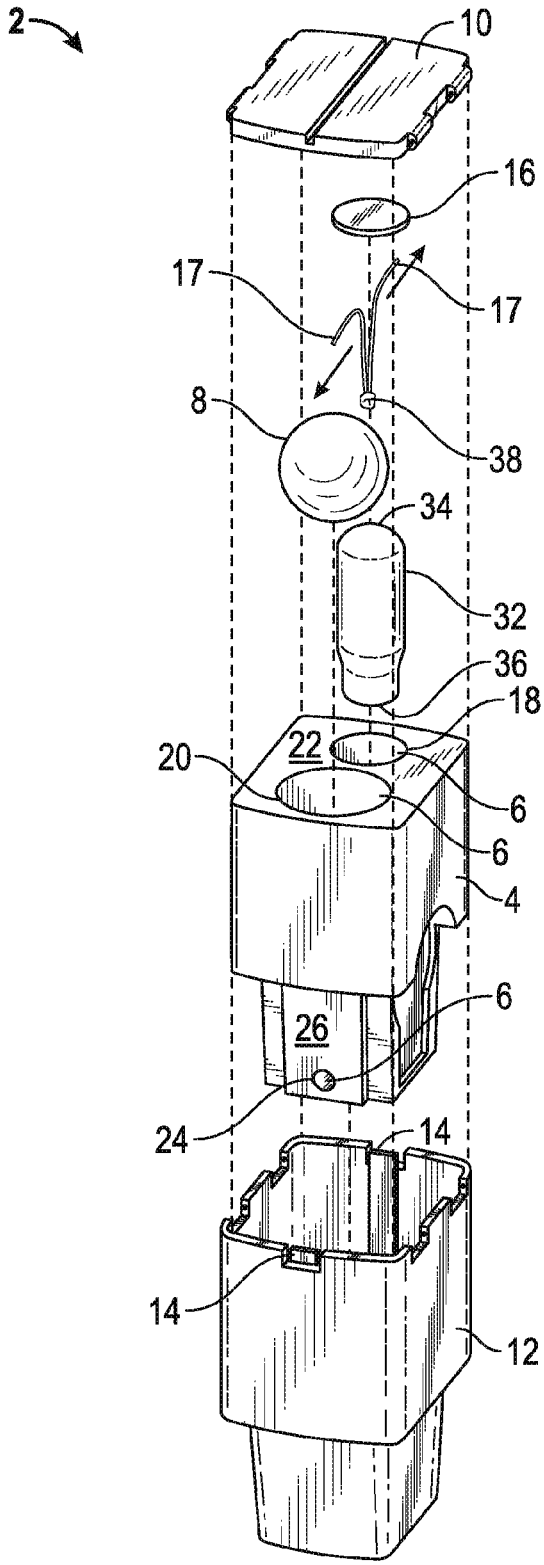
FIG. 3 is an exploded perspective view of an implementation of ammunition for a conductive energy weapon.
Figure 4:
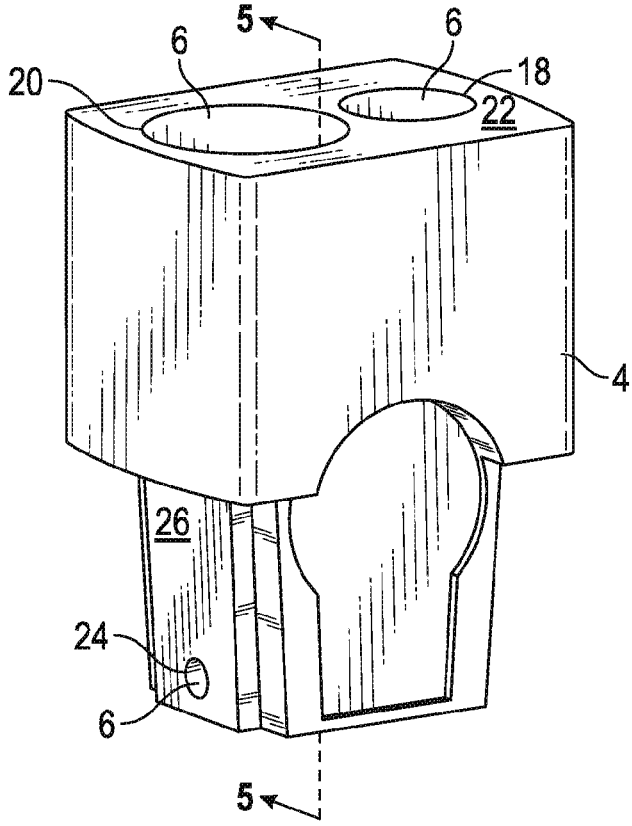
FIG. 4 is a perspective view of an implementation of a receptacle of ammunition for a conductive energy weapon.
Figure 5:
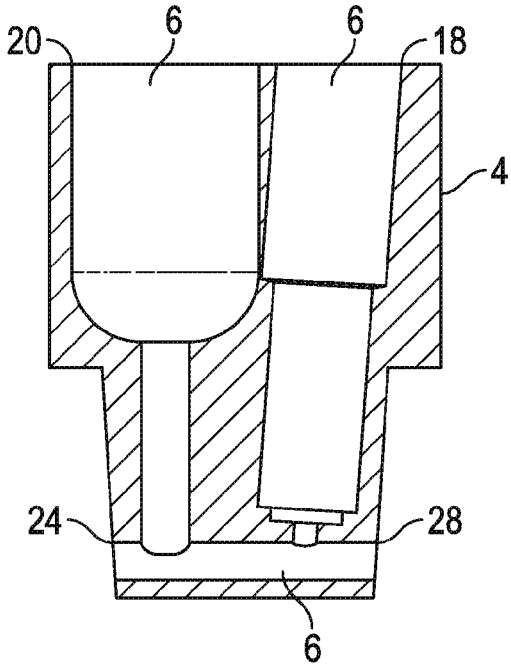
FIG. 5 is a cross-section view of the receptacle of FIG. 4 taken along line 5-5.
Figure 6:
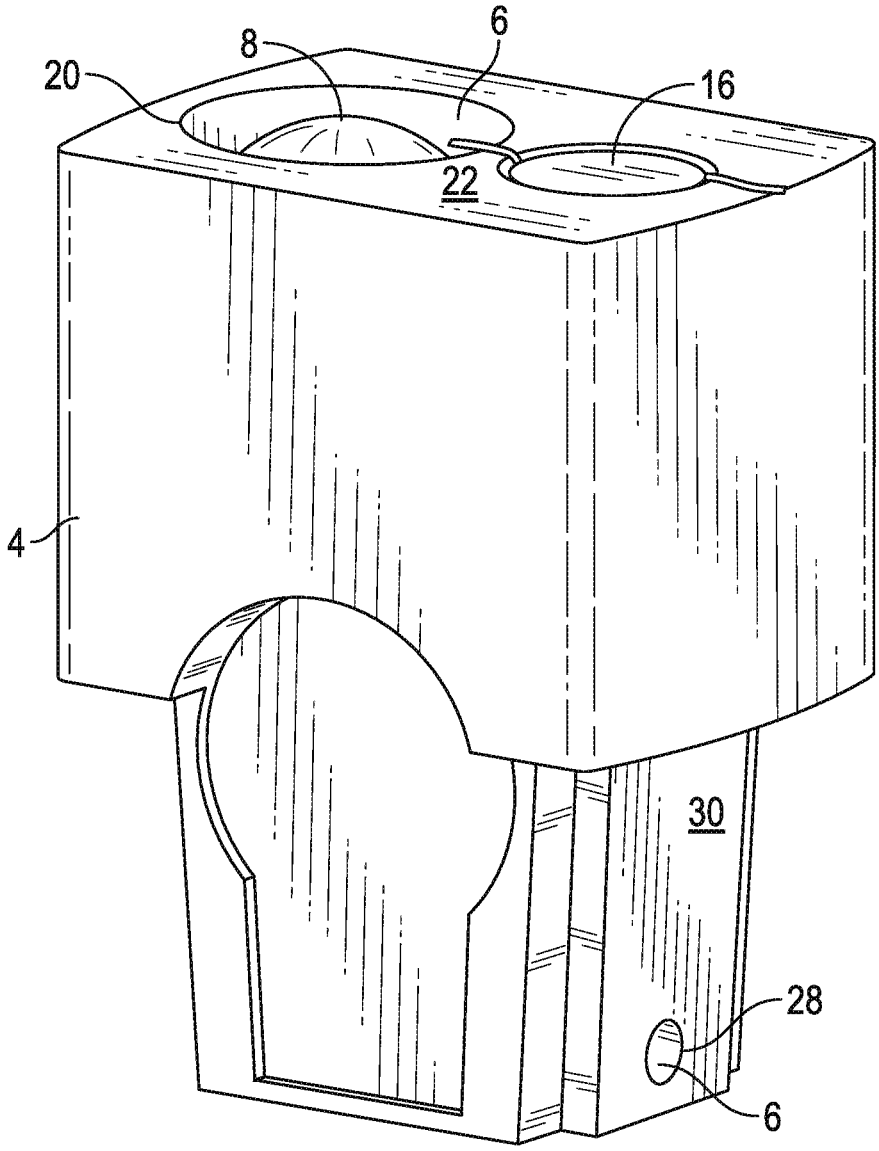
FIG. 6 is a perspective view of a receptacle and other components of an implementation of ammunition for a conductive energy weapon.

The electrical conductors 14 are configured to electrically couple the leads 17 of the explosive 38 with a power source (such as, by non-limiting example, a battery, shock generator, or any other source of electrical power) contained in the conductive energy weapon, so that pulling the trigger of the conductive energy weapon may result in providing electricity to the leads 17 that explodes the explosive 38. In implementations the electrical conductors 14 include metal strips extending downwards along the inside of the housing 12 from top to bottom. In FIG. 3 a small recess may be seen in the top of the housing 12, which makes the electrical conductors 14 visible from outside the housing 12. In implementations the electrical conductors 14 may be configured to couple to the power source of the conductive energy weapon through the recess (such as, by non-limiting example, by electrodes of the conductive energy weapon touching the electrical conductors 14 through the recess). In implementations the electrical conductors 14 may exit the housing 12 alternatively or additionally in some other location, such as at the bottom of the housing 12 (the recesses being at the top of the housing 12) in order to couple to electrodes or other leads or couplers to the power source of the conductive energy weapon. In implementations the electrical conductors 14 need not be metal so long as they conduct electricity sufficiently to fire the explosive 38. In implementations the electrical conductors 14 need not be strips but could be wires, plates, or some other configuration. In implementations the electrical conductors 14 are coupled to the receptacle 4 instead of the housing 12.

The seal (wadding) 16 in implementations couples to the housing 12 in a way that it covers the first opening 18. In implementations the seal 16 may be omitted from the ammunition 2. By non-limiting example, in implementations the propellant unit 32 may form a substantially air-tight seal with the sidewalls of the cavity 6 such that no seal 16 is required. In implementations a substantially air-tight seal may not be required for the ammunition 2 to function as desired. By non-limiting example, in implementations the propellant unit 32 may have threads whereby it is held into place, so that the force of a fluid exiting the pierced propellant unit 32 will not cause the propellant unit 32 to exit the cavity 6 through the first opening 18 and, in implementations, any fluid or pressure escaping from the cavity 6 upwards past the propellant unit 32 through the first opening 18 will not substantially affect the performance of the ammunition 2, including its ability to discharge the projectile 8 with sufficient velocity at a desired target.

The seal 16 may be coupled to the housing 12 by various mechanisms such as, by non-limiting example: a friction fit, glue, a snap-in or snap-on mechanism, threads, and the like. In implementations the leads 17 exit the cavity 6 and pass between the receptacle 4 and seal 16 to reach the electrical conductors 14. In implementations the leads 17 could be incorporated into the seal 16 itself and/or in implementations the seal 16, leads 17 and explosive 38 could be incorporated into a single unit.

In implementations the first opening 18, second opening 20, third opening 24 and fourth opening 28 all have substantially circular shapes. In other implementations they may have other shapes such as square, rectangular, triangular, oval, and any other regular or irregular closed shape. Similarly, they may have other sizes than those depicted in the drawings and may be placed in other locations and on other faces of the receptacle 4. In implementations the third opening 24 and/or the fourth opening 28 may be omitted from the receptacle 4 such that the receptacle 4 only has two openings or three openings allowing access to the cavity 6. In other implementations more than four openings may be included, each allowing access to the cavity 6. In implementations the second opening 20 could be included not in the first face 22 but instead on the second face 26, third face 30, a bottom face, or some other face of the receptacle 4.

In implementations the first face 22, second face 26 and third face 30 are each substantially flat, though in implementations either or some or all of them may have some curvature or irregularity to their surface/shape. In implementations the first face 22 is substantially perpendicular to both the second face 26 and third face 30 though in other implementations the first face 22 may not be substantially perpendicular with either the second face 26 or the third face 30. In implementations the second face 26 and third face 30 are substantially parallel with one another though in implementations the second face 26 and third face 30 need not be substantially parallel with one another.

The propellant unit 32 includes a mechanism for propelling the projectile 8 towards a target. By non-limiting example, in implementations the propellant unit 32 includes a compressed fluid container containing a gas, such as nitrogen, or some other gas or fluid. In implementations the propellant unit 32 may include a combustible material that rapidly forms a gas, the rapidly forming gas being used as a propellant for the projectile 8. In such an implementation the explosive 38 may be utilized to ignite the combustible material or the explosive 38 may be omitted and the leads 17 may be used to ignite the combustible material or to ignite a fuse or other element which in turn ignites the combustible material. In implementations wherein the propellant unit 32 includes a compressed fluid container the fluid may be a liquid or a gas. In implementations the ammunition 2 may be configured to selectively open a punctured portion of the compressed fluid container to the cavity 6 such that the same compressed fluid container could be used for more than one discharge of a projectile 8. In such implementations an explosive 38 may be omitted and some other device incorporated into the ammunition 2 may be used to selectively open and close the punctured portion. For example, the propellant unit 32 may have threads and may be configured to screw into threads of the receptacle 4 such that the screwing process brings the propellant unit 32 in contact with a mechanical pierce to puncture the propellant unit 32 but the screwing also brings the propellant unit 32 in contact with a seal that prevents fluid from escaping the propellant unit 32 into the cavity 6 until a trigger pull of the conductive energy device causes some mechanism or element of the ammunition 2 to selectively remove or break the seal so as to let some of the compressed fluid escape into the cavity 6 to discharge a projectile 8.

The second end 36 of the propellant unit 32 in implementations is configured to be rupturable by a mechanical pierce. By non-limiting example, in implementations the bottom or sidewall of the propellant unit 32 proximate the second end 36 has a thickness that is such that a mechanical pierce will be able to puncture a hole in the propellant unit 32 after the explosive 38 causes the propellant unit 32 to move towards the mechanical pierce.

The explosive 38 in implementations may include any mechanism, composition, and the like configured to impart motion to the propellant unit 32 so as to move it towards the bottom of the ammunition 2 (and, accordingly, to a mechanical pierce or other piercing mechanism configured to pierce the propellant unit 32). In implementations the explosive 38 includes a miniature explosive device known as a squib.

The leads 17 electrically couple the explosive 38 to the electrical conductors 14. In implementations the leads 17 couple to the electrical conductors 14 proximate the top of the ammunition 2 (the top being the end closest to the openable member 10). By non-limiting example, referring to FIG. 2, in implementations one lead 17 may couple to one electrical conductor 14 and the other lead 17 may couple to the other electrical conductor 14. In FIG. 3 one of the leads 17 is seen touching an electrical conductor 14 but the other lead 17 is not seen touching an electrical conductor 14, though it is to be understood that this lead 17 in some way is coupled to the other electrical conductor 14 such as, by non-limiting example, by extending the lead 17 across the top of the receptacle 4 to touch the other electrical conductor 14 (though, in implementations, in a manner such that it does not cross the path of the second opening 20, so as to not interrupt the flight of the projectile 8 and/or so as to not allow the projectile 8 to rupture that lead 17 upon discharge). In other implementations a conductive element is placed on the bottom of the openable member 10 such as, by non-limiting example, a wire, strip, plate, metallic foil, or the like, which electrically couples one or more of the leads 17 to the electrical conductor(s) 14 when the openable member 10 is in place. In other implementations the leads 17 could couple to the electrical conductors 14 at another location. By non-limiting example, in implementations the electrical conductors 14 could be metal strips that extend downwards along the length of the inside of the housing 12 from about the top to about the bottom of the housing 12, such that they form the substantially air-tight seal with the receptacle 4 at the third opening 24 and fourth opening 28, and the leads 17 may travel downwards through the cavity 6 (or through another cavity or cavities) to couple to the electrical conductors 14 through the third opening 24 and fourth opening 28. In such implementations the leads 17 may exit the receptacle 4 through the third opening 24 and fourth opening 28 without substantially affecting the substantially air-tight seal though, in other implementations, the leads 17 may not exit the receptacle 4 but may contact the electrical conductors 14 through the third opening 24 and fourth opening 28 without exiting the receptacle 4 and, thus, not affecting the substantially air-tight seal.

The direction of flight of the projectile 8, in implementations, is generally aligned with and substantially parallel to a longest length of a muzzle of the conductive energy weapon. In implementations the direction of flight of the projectile 8 is in a direction that is substantially perpendicular to the first face 22 of the receptacle 4.

A flow path of the propellant in implementations may include a path from the second end 36 of the propellant unit 32, through the cavity 6, to the projectile 8. The propellant may follow this path to reach the projectile 8 to accelerate and discharge the projectile 8 from the receptacle 4 during a firing operation when a trigger, button or other activation mechanism of the conductive energy weapon is engaged.

Figure 7:
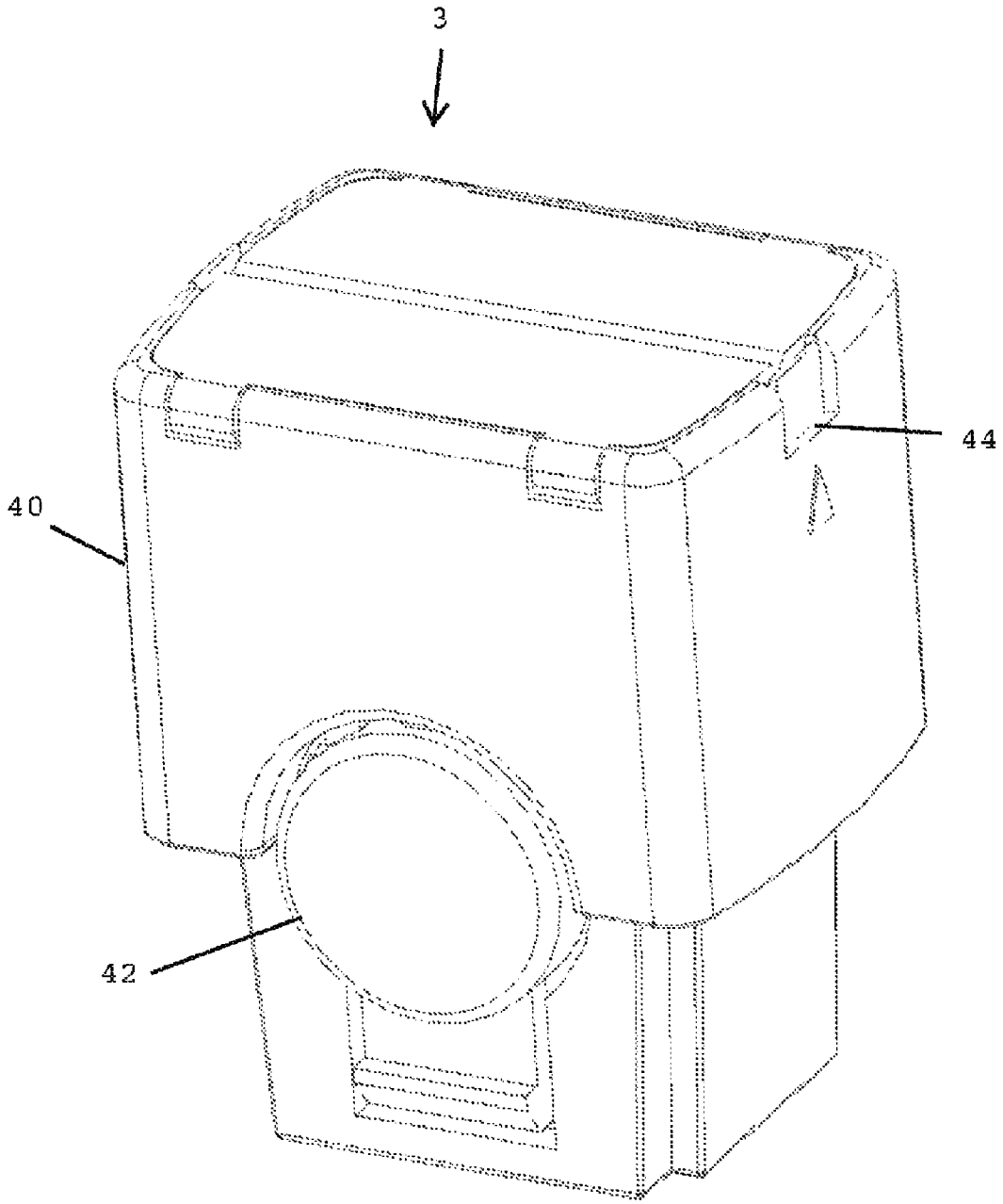
FIG. 7 is a perspective view of an implementation of ammunition for a conductive energy weapon.
Figure 8:
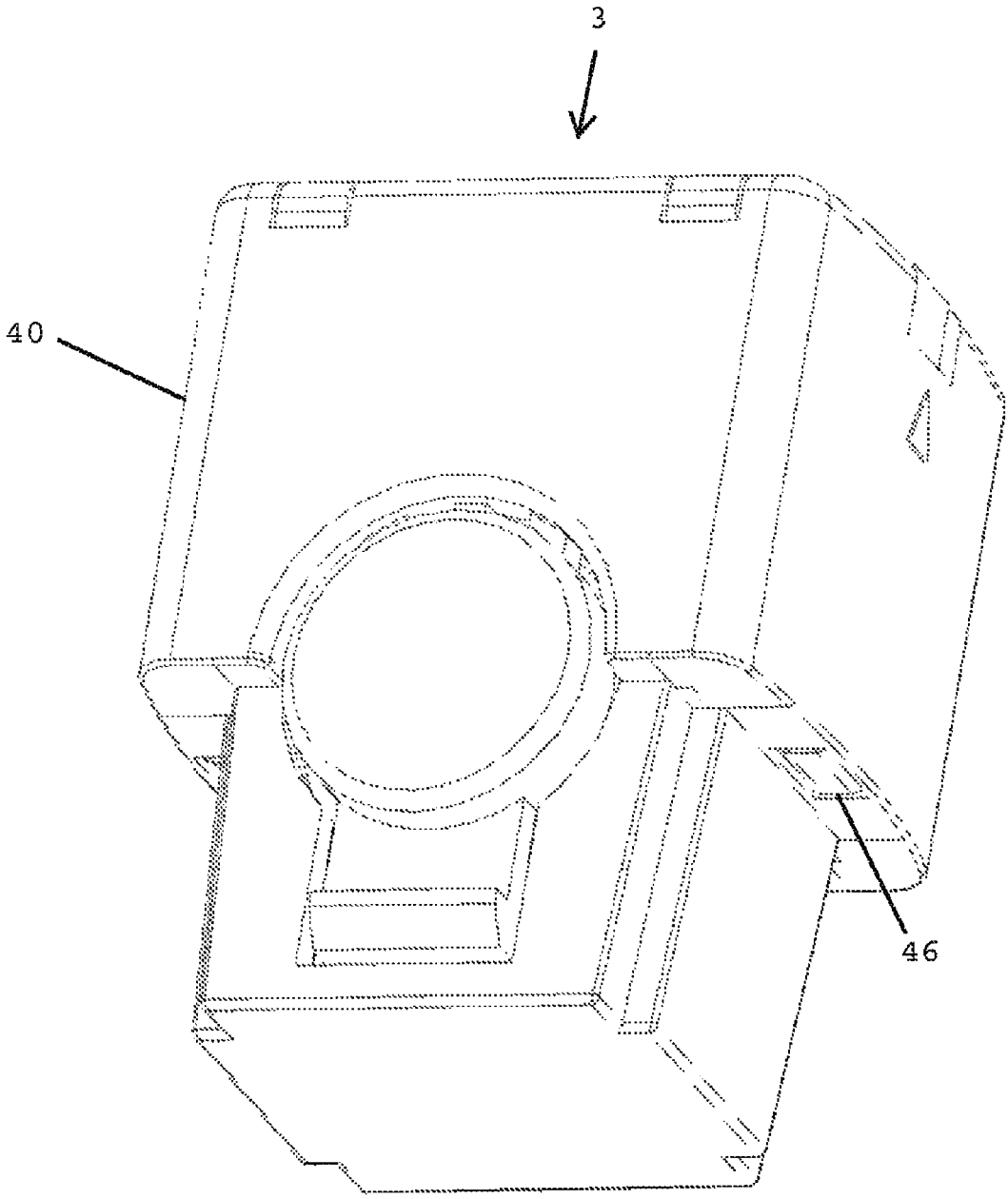
FIG. 8 is a perspective view of an implementation of ammunition for a conductive energy weapon.

Referring now to FIGS. 7-8, various implementations of ammunition 3 include a housing 40. In implementations housing 40 includes a release mechanism 42 which allows the housing 40 to be snap into and be released from the conductive energy weapon at the desire of a user. The release mechanism 42 shown in FIG. 6 includes a push-button mechanism. When inserting the housing 40 into a cavity of a muzzle of a conductive energy weapon the release mechanism 42 will automatically snap into place upon reaching a certain depth such that the housing 40 will be locked into place, and a user may then release the housing 40 by pushing the push button, then pulling the housing 40 out of the cavity of the muzzle. In implementations the housing 40 has an opening 44 on each side of the housing 40 proximate the top of the housing 40 which allows access to a cavity extending down the sidewall of the housing 40. This cavity receives the electrical conductors 14, which then exit the housing 40 at the openings 46 on each side of the housing 40 further down the sidewall, to engage electrodes of the conductive energy weapon when the housing 40 is snapped into place in a conductive energy weapon.

Figure 9:
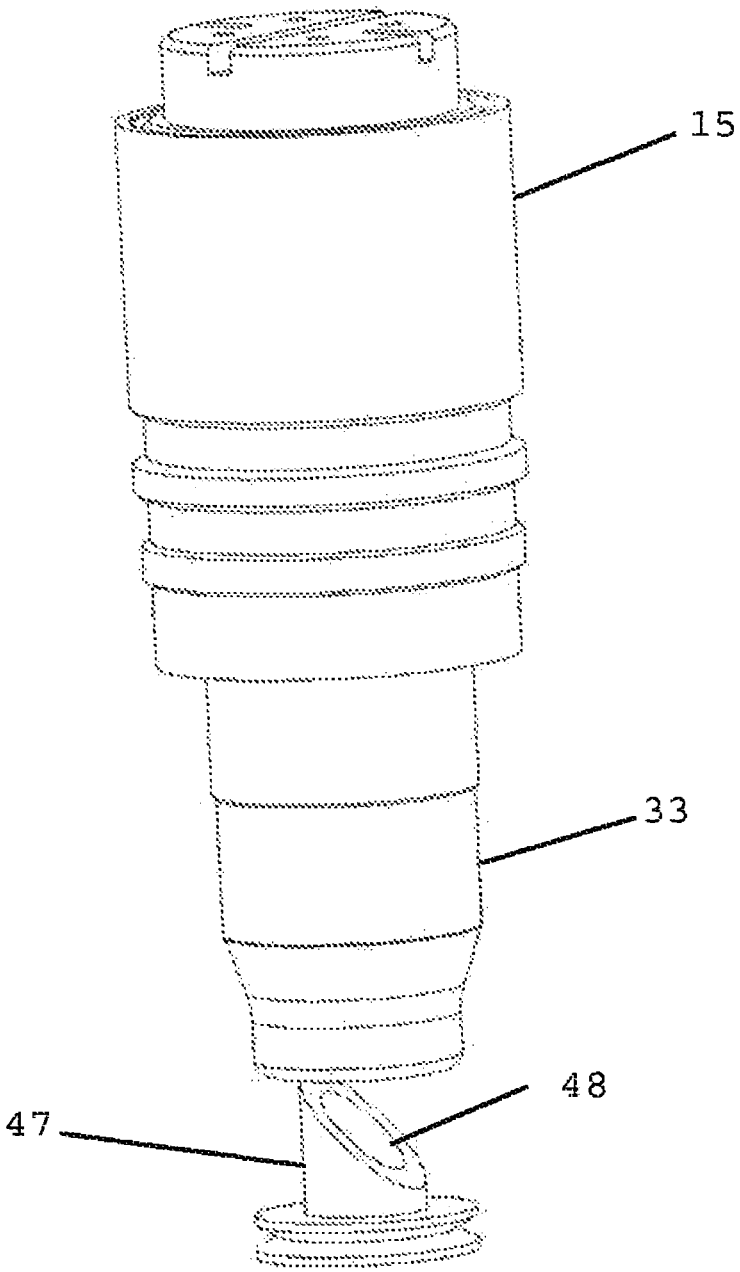
FIG. 9 is a perspective view of implementations of a seal, a propellant unit, a mechanical pierce and related components of ammunition for a conductive energy weapon.

FIG. 9 shows an implementation of a seal 15, propellant unit 33 and mechanical pierce 47 of ammunition 3. The seal 15 partially encases the propellant unit 33 and forms a substantially air-tight seal with the receptacle 4 at the sidewalls of the cavity 6 and/or at the first opening 18. Mechanical pierce 47 has a through-hole 48 through which the propellant may follow the flow path through the cavity 6 to the projectile 8.

Figure 10:
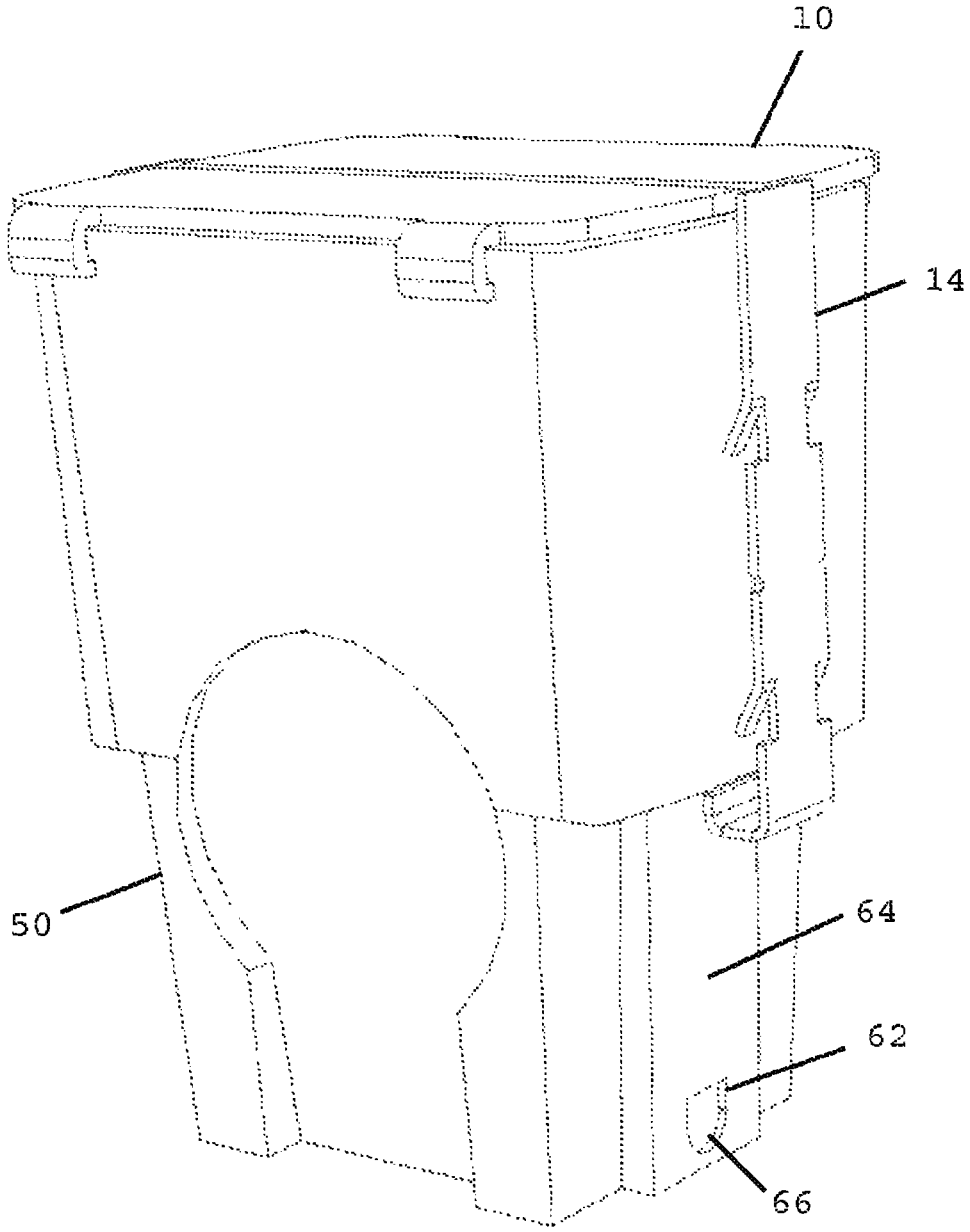
FIG. 10 is a perspective view of implementations of a receptacle, an electrical conductor, an openable member and related components of ammunition for a conductive energy weapon.
Figure 11:
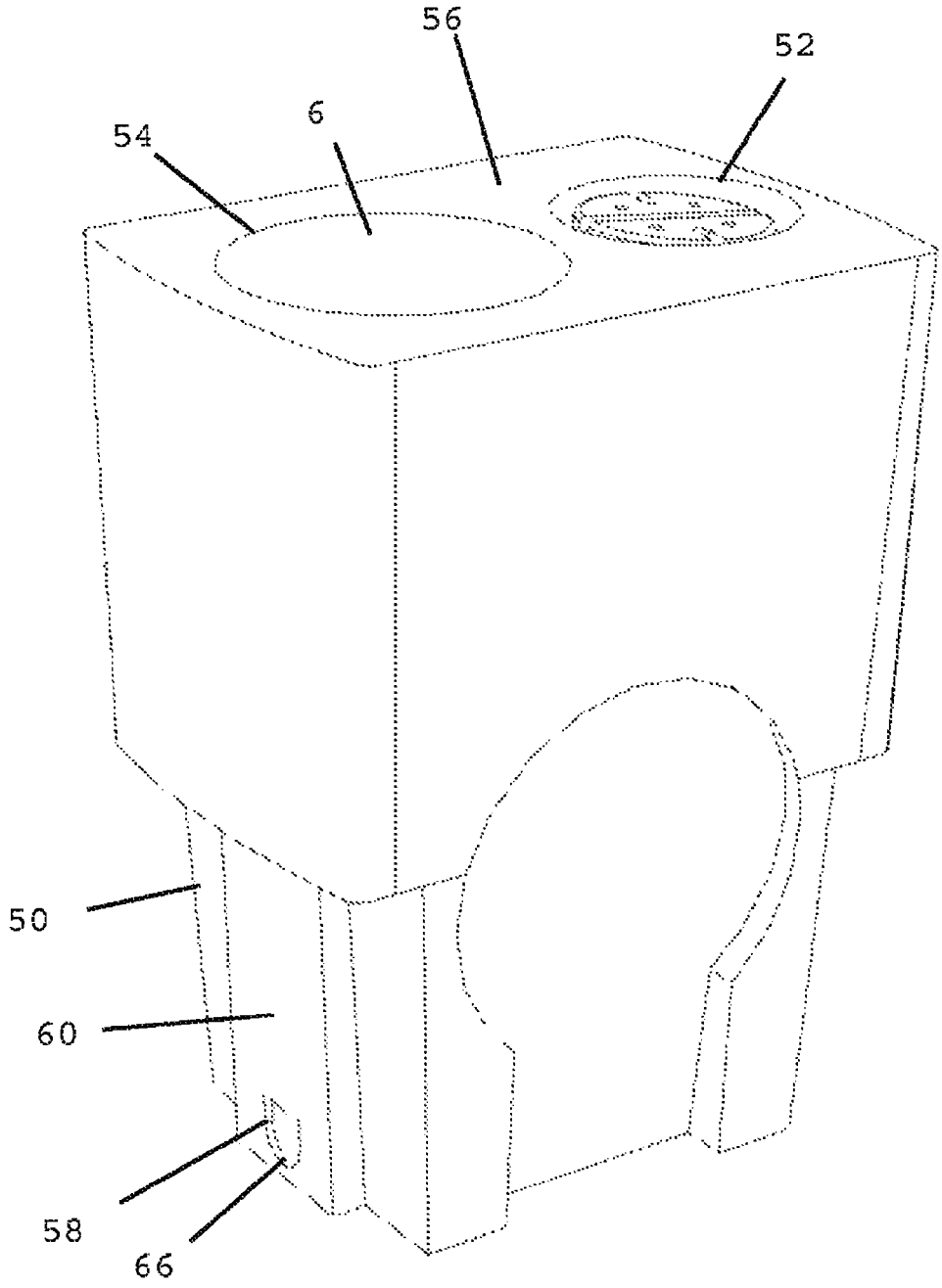
FIG. 11 is a perspective view of an implementation of a receptacle and related components of ammunition for a conductive energy weapon.
Figure 12:
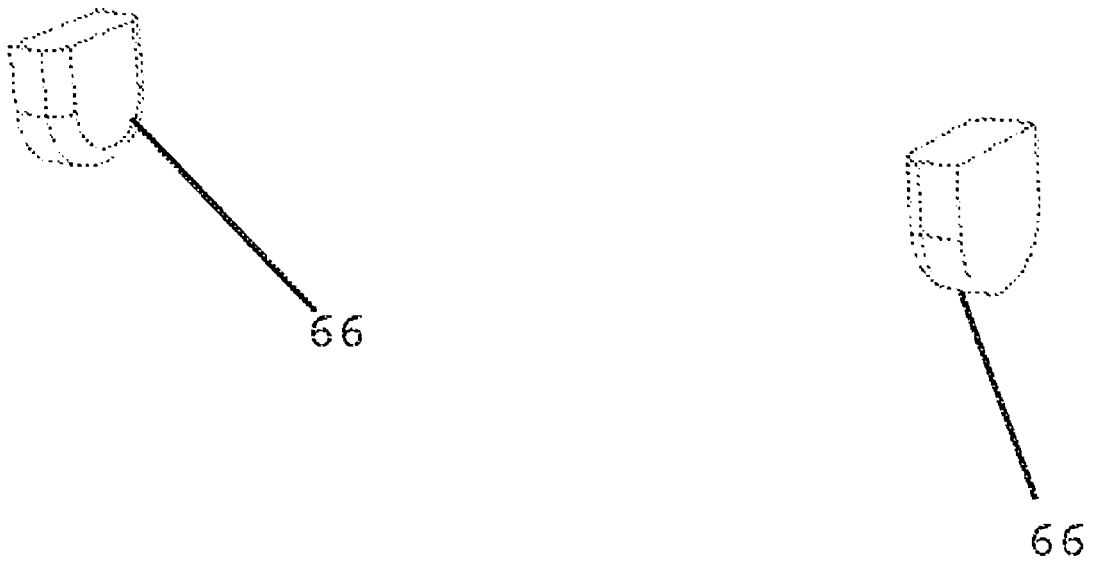
FIG. 12 is a perspective view of an implementation of plugs for ammunition for a conductive energy weapon.

FIG. 10 shows an implementation of a receptacle 50. An openable member 10 is shown resting atop the receptacle 50 and an electrical conductor 14 is shown floating to the side of the receptacle 50 where it would generally reside when the housing 40 is in place. Referring to FIGS. 10-11, the receptacle 50 has a first opening 52 and second opening 54 in a first face 56, a third opening 58 in a second face 60 and a fourth opening 62 in a third face 64. A plug 66 is shown in the third opening 58 and fourth opening 62, slightly recessed from the second face 60 and third face 64, respectively. A plug 66 or similar plug may be placed in the third opening 24 and/or fourth opening 28 of the receptacle 4. The plug 66 in implementations forms a substantially air-tight seal with the receptacle 4 or 50, by forming a substantially air-tight seal with the sidewalls of receptacle 4 or 50 defining the cavity 6, proximate the third opening 24 or 58 or fourth opening 62 or 28. FIG. 12 shows an implementation of a plug 66. The plug 66 in implementations may be formed of a polymer, and may be soft or hard, elastic or inelastic, and in implementations may be removably coupled to the receptacle 4 or 50. In implementation the plug 66 may be held in place temporarily or permanently using, by non-limiting example: a friction fit, a glue, and the like.

Implementations of an ammunition 2 or 3 may include one or more or all elements of devices disclosed in the following U.S. patent references, particularly those relating to darts and components related to dart delivery the disclosures of each of which are entirely incorporated herein by reference: U.S. Pat. No. 7,944,676 to Smith et al., issued May 17, 2011, entitled "Systems and methods for collecting use of force information"; U.S. Pat. No. 8,045,316 to Nerheim, issued Oct. 25, 2011, entitled "Systems and methods for predicting remaining battery capacity"; U.S. Pat. No. 8,320,098 to Klug et al., issued Nov. 27, 2012, entitled "Electronic weaponry with manifold for electrode launch matching"; U.S. Pat. No. 7,600,337 to Nerheim et al., issued Oct. 13, 2009, entitled "Systems and methods for describing a deployment unit for an electronic weapon"; U.S. Pat. No. 7,637,411 to Baldwin, issued Mar. 9, 2010, entitled "Systems and methods for electrode drag compensation"; U.S. Pat. No. 7,859,818 to Kroll et al., issued Dec. 28, 2010, entitled "Electronic control device with wireless projectiles"; U.S. Pat. No. 7,075,770 to Smith, issued Jul. 11, 2006, entitled "Less lethal weapons and methods for halting locomotion", and; U.S. Pat. No. 7,305,787 to Stratbucker, issued Dec. 11, 2007, entitled "Systems and methods for incapacitating using biofeedback".

In implementations the propellant of a propellant unit 32 or 33 may include a gas and a liquid. In implementations the propellant of a propellant unit 32 or 33 may include a gel. In implementations the propellant of a propellant unit 32 or 33 may itself include a deterrent or inhibiting material, such as mace, pepper spray, pepper gel, or another liquid, gel and/or gas element that is used to deter, inhibit or immobilize a target. By way of non-limiting example, in implementations the projectile 8 of an ammunition 2 or 3 may include a common electrode dart or darts to transmit an immobilizing electric current to a target and the propellant used to accelerate the dart to the target may itself contain pepper spray, mace, pepper gel, or the like to further inhibit, deter or immobilize the target. In these implementations, the maximum range of the dart may be about 15 to about 21 feet, while the maximum range of the deterrent in the propellant may be shorter. Implementations of gas/liquid propellants containing a deterrent may also be used with any of the other ammunition types disclosed herein, including pepper balls, where the pepper ball may have a range of about 30 feed while the deterrent may have a range of about 15 feet. The portion of the gas that may be used in the propellant may be carbon dioxide, argon, or any other gaseous propellant disclosed herein. The liquid portion of the propellant that may be used in various implementations may be liquid forms of pepper spray, mace, pepper gel, either alone, or in combination with any other desired liquid for use as a carrier/preservative, etc. Implementations of propellant units that utilize both liquid and gas may be referred to as hydro-pneumatic canisters. The length or other dimension of the propellant unit may be increased, decreased, or otherwise altered as desired to aid in directing the movement of the gas and the liquid through the receptacle.

In places where the description above refers to particular implementations of conductive energy weapon ammunition and related methods, and implementing components, sub-components, methods and sub-methods, it should be readily apparent that a number of modifications may be made without departing from the spirit thereof and that these implementations, implementing components, sub-components, methods and sub-methods may be applied to other implementations of conductive energy weapon ammunition and related methods.

What is claimed is:

1. Ammunition for a conductive energy weapon, comprising:

a receptacle having a cavity therein, the cavity accessible through each of a first opening in a first face of the receptacle, a second opening in the first face of the receptacle, a third opening in a second face of the receptacle and a fourth opening in a third face of the receptacle, wherein the first opening is offset from a center of the first face;

a propellant unit comprised within the cavity proximate the first opening;

a projectile comprised within the cavity proximate the second opening, and;

a housing coupled to the receptacle, the housing configured to couple to a conductive energy weapon;

wherein the second face is substantially parallel with the third face, and wherein the cavity is accessible through only the first through fourth openings of the receptacle.

2. Ammunition for a conductive energy weapon, comprising:

a receptacle having a cavity therein, the cavity accessible through each of a first opening in a first face of the receptacle, a second opening in the first face of the receptacle, a third opening in a second face of the receptacle and a fourth opening in a third face of the receptacle, wherein the first opening is offset from a center of the first face;

a propellant unit comprised within the cavity proximate the first opening;

a projectile comprised within the cavity proximate the second opening, and;

a housing coupled to the receptacle, the housing configured to couple to a conductive energy weapon;

wherein the housing is configured to cover substantially all of the receptacle except the first face, and wherein the ammunition comprises only a single projectile.

3. Ammunition for a conductive energy weapon, comprising:

a receptacle having a cavity therein, the cavity accessible through a first opening in a first face of the receptacle and a second opening in the first face of the receptacle, wherein both the first opening and the second opening are offset from a center of the first face;

a propellant unit comprised within the cavity;

a projectile comprised within the cavity, and;

a housing coupled to the receptacle and configured to couple to a conductive energy weapon;

wherein the propellant unit is configured to release a propellant into the cavity, in a direction substantially opposite a direction of flight of the projectile, in response to a trigger pull of a conductive energy weapon, and;

wherein the cavity is configured to direct the released propellant in the direction of flight of the projectile; and wherein the cavity is configured to cause the propellant to make two about ninety-degree turns on a flow path from the propellant unit to the projectile, and wherein the cavity is accessible through only four openings of the receptacle, two of the only four openings being the first opening and the second opening.

4. Ammunition for a conductive energy weapon, comprising:

a receptacle having a cavity therein, the cavity accessible through a first opening in a first face of the receptacle and a second opening in the first face of the receptacle, wherein both the first opening and the second opening are offset from a center of the first face;

a propellant unit comprised within the cavity;

a projectile comprised within the cavity, and;

a housing coupled to the receptacle and configured to couple to a conductive energy weapon;

wherein the propellant unit is configured to release a propellant into the cavity, in a direction substantially opposite a direction of flight of the projectile, in response to a trigger pull of a conductive energy weapon, and;

wherein the cavity is configured to direct the released propellant in the direction of flight of the projectile; and the ammunition further comprising a seal configured to form a substantially airtight seal with the receptacle at one of the second opening and a sidewall of the cavity proximate the second opening, and wherein the ammunition comprises only a single projectile.

* * * * *